US009488047B2

(12) United States Patent
Zhao et al.

(10) Patent No.: US 9,488,047 B2
(45) Date of Patent: Nov. 8, 2016

(54) RESERVOIR CALIBRATION PARAMETERIZATION METHOD

(75) Inventors: Yong Zhao, Katy, TX (US); Martin Mlacnik, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 610 days.

(21) Appl. No.: 13/437,342

(22) Filed: Apr. 2, 2012

(65) Prior Publication Data

US 2012/0323544 A1 Dec. 20, 2012

Related U.S. Application Data

(60) Provisional application No. 61/471,517, filed on Apr. 4, 2011.

(51) Int. Cl.
*E21B 49/00* (2006.01)
*E21B 43/00* (2006.01)

(52) U.S. Cl.
CPC ..... *E21B 49/00* (2013.01)

(58) Field of Classification Search
CPC ..... G06F 17/5009; G06F 2217/16; G06F 17/11; G06F 17/13; G06F 17/16; G01V 99/005; G01V 1/30; G01V 1/28; G01V 1/282; G01V 1/36; G01V 2210/644; G01V 2210/665; E21B 43/00; E21B 47/00; E21B 43/12
USPC ..... 703/2, 10
See application file for complete search history.

(56) References Cited

U.S. PATENT DOCUMENTS 4,910,716 A 3/1990 Kirlin et al.
4,951,266 A 8/1990 Hsu
4,969,130 A 11/1990 Wason et al.

(Continued)

FOREIGN PATENT DOCUMENTS

| | | |
|---|---|---|
| WO | 9506886 | 3/1995 |
| WO | 2006003118 | 1/2006 |
| WO | 2006031383 | 3/2006 |

OTHER PUBLICATIONS

Panav Sarma. "Kernel Principal Component Analysis for Efficient, Differential Parameterization of Multipoint Geostatistics," Jul. 20, 2006, Math Geosci, Springer, pp. 3-32.*

(Continued)

*Primary Examiner* — Omar Fernandez Rivas
*Assistant Examiner* — Shiuh-Huei Ku
(74) *Attorney, Agent, or Firm* — ConocoPhillips Company

(57) ABSTRACT

A method is described for producing an amended realization of a geostatistical model of a hydrocarbon reservoir using the Karhunen-Loève (KL) expansion. The KL expansion may be used to produce amended realizations for history matching and is widely used. However, it is necessary in order to use the KL expansion to perform singular value decomposition of the covariance matrix of the model to provide eigenvectors and eigen values for use in the expansion. In a typical geostatistical model, the covariance matrix is too large for singular value decomposition to be performed. Prior solutions to this problem involved reducing the resolution of the model so as to reduce the size of the covariance matrix. In the method described, a plurality of random realizations are generated and an approximation of the covariance matrix is constructed from the realizations, the approximation matrix having smaller dimensions than the true covariance matrix.

18 Claims, 2 Drawing Sheets

(56) References Cited

U.S. PATENT DOCUMENTS

| | | | | |
|---|---|---|---|---|
| 5,047,991 | A | 9/1991 | Hsu | |
| 5,305,209 | A | 4/1994 | Stein et al. | |
| 5,475,589 | A | 12/1995 | Armitage | |
| 5,764,515 | A | 6/1998 | Guerillot et al. | |
| 6,754,588 | B2 | 6/2004 | Cross et al. | |
| 6,826,483 | B1 | 11/2004 | Anderson et al. | |
| 6,980,940 | B1 | 12/2005 | Gurpinar et al. | |
| 7,254,091 | B1 | 8/2007 | Gunning et al. | |
| 7,277,796 | B2 | 10/2007 | Kuchuk et al. | |
| 7,333,392 | B2 | 2/2008 | Burnstad | |
| 2003/0028325 | A1* | 2/2003 | Roggero | G01V 11/00 702/11 |
| 2006/0241925 | A1 | 10/2006 | Schaaf et al. | |
| 2007/0118346 | A1 | 5/2007 | Wen et al. | |
| 2008/0212841 | A1 | 9/2008 | Gauthier et al. | |
| 2009/0166033 | A1* | 7/2009 | Brouwer | E21B 43/00 166/250.02 |
| 2010/0305863 | A1* | 12/2010 | Abubakar | G01V 11/00 702/7 |

OTHER PUBLICATIONS

Stephen, K. D., and C. MacBeth, "Reducing reservoir prediction uncertainty using seismic history matching" Proceedings of the SPE Europe/EAGE Annual Conference and Exhibition, Paper 100295. (2006).

Stephen & McBeth, , "Inverting for the petro-elastic model via seismic history matching," SEG/New Orleans 2006 Annual Meeting, : 1688-92 (2006).

Rodriguez, et al., "Assessing Multiple Resolution Scales in History Matching With Metamodels," SPE 105824 (2007).

Sarma, et al., "Kernel Principal Component Analysis for Efficient, Differentiable Parameterization of Multiple Point Geostatistics.", 2006.

* cited by examiner

RESERVOIR CALIBRATION PARAMETERIZATION METHOD

CROSS-REFERENCE TO RELATED APPLICATIONS

This application is a non-provisional application which claims benefit under 35 USC §119(e) to U.S. Provisional Application Ser. No. 61/471,517 filed Apr. 4, 2011, entitled "RESERVOIR SIMULATION," which is incorporated herein in its entirety.

STATEMENT REGARDING FEDERALLY SPONSORED RESEARCH

None.

FIELD OF THE INVENTION

The present disclosure relates generally to methods and apparatus for creating amended realizations of a geostatistical model of a reservoir of hydrocarbon deposits for use in so-called history matching, in which the model is updated to take into account updated dynamic data (e.g. flow data) measured from the actual reservoir.

BACKGROUND OF THE INVENTION

Subsurface geological modeling involves estimating parameters of interest for development planning and production forecasting; when a model has been constructed using these parameters, it is used to make predictions of e.g. flow rates from wells. Parameters used to construct the model can include e.g. porosity and permeability of rock. These parameters are directly measured, e.g. at locations where the subsurface has been penetrated by wells through which various tools are run to take measurements. The reservoir model at the sample locations is conditioned by these sample measurements with no or only slightly attached uncertainty. Between well locations, however, estimates of target parameters with attached measures of uncertainty are required.

Reservoir modeling is a statistical process which produces a potentially infinite number of so-called realizations of a given model. Each realization consists of a matrix comprising several values (representing parameters such as porosity and permeability) associated with each of a large number of cells distributed over the volume of the reservoir. Only for a relatively small number of these cells will the values be known with relative certainty (namely those cells for which the parameters have been measured). For the remaining cells, the values are estimates based on the geostatistical modeling process. Each realization will have a different set of estimated values.

The modeling process results in estimated values which are more reliable for some cells than others; the estimated values also have differing degrees of statistical inter-dependence. The model has a so-called covariance matrix associated with it which contains information about the variance and statistical inter-dependence (covariance) of the estimated values. The covariance matrix has dimensions n×n, where n is the number of uncertainty parameters in the system, e.g. equating to the number of cells in the model, or more if more than one parameter is associated with each cell. The value of the covariance between two data points i and j in the model can be found at the (i,j) coordinate in the covariance matrix. Hence the values (i,i) on the leading diagonal of the matrix will all have the value equal to variance of the $i^{th}$ parameter since each value i will be perfectly correlated with itself, whilst elsewhere the values will range between 0 and the variance.

The model is used to make predictions of various reservoir flow responses such as flow rates and pressures in wells and 4D seismic signatures. Using flow rates as an example, flow rate data will be gathered from the wells over time once the reservoir is in production and will, generally, differ from the predicted values generated by the model. History matching is a process by which new realizations of the model are generated which more accurately predict the correct current flow rates and can therefore be assumed to be intrinsically more accurate and therefore to be able to make more accurate predictions of future flow rates. In any history matching process creating updated realizations, it is important to preserve the statistical data on which the model is based; this means involving the covariance matrix in the updating process.

In history matching, one or more realizations are modified so that the theoretical flow rates (or other dynamic data) which they predict match with, or more closely approximate to, the measured flow rates (or other dynamic data). As mentioned above, for any modification, it is important that the statistical data inherent in the model is preserved.

The so-called Karhunen-Loève expansion may be used for this process:

$$\hat{m} = m + \sum_{j=1}^{N} c_j \lambda_j u_j$$

In this expression, a new realization $\hat{m}$ is generated by adding to the old realization m a summation term for a linear combination of eigenvectors uj of the covariance matrix, the corresponding eigen values λj and modifying coefficients cj for j=1 to N where N is the total number of values in the realization. Each of these eigenvectors has the same dimension as the model but with a different level of detail.

$\lambda_j$—an eigen value (scalar quantity)

$u_j$—an eigenvector (a vector with the same dimension as the model matrix)

$c_j$—a modifying coefficient (scalar quantity)

The eigenvectors and eigen values are derived from the covariance matrix and represent information about the variance and statistical inter-dependence of the values in any realization from the model. Their inclusion in the Karhunen-Loève expression means that the variance and statistical inter-dependence of the values in the amended realization will be preserved. The variable $c_j$ is an artificial input to amend the realization; if $c_j$ were set to zero for all terms j, then the summation term would be zero and there would be no amendment of the realization. Algorithms exist which can be used to generate values for $c_j$ which result in the flow predictions made by the model being amended in certain ways. However, essentially, the process is one of trial and error to establish a range of values for $c_j$ which create an appropriate amendment to the model.

The mathematical process by which the eigenvectors and eigen values are derived from the covariance matrix is known as singular value decomposition (or SVD) of the covariance matrix. SVD is a well known process and is not the subject of this application.

A practical reservoir model will have in excess of a million cells each associated with several values. The covariance matrix for such a model is extremely large; a model with a million cells would have a 1,000,000×1,000,000 covariance matrix or greater. Carrying out SVD on a covariance matrix for a real-life reservoir model is computationally unfeasible at the present time. Therefore, up to now, in order to perform history matching using the Karhunen-Loève expansion, it has been necessary to work on a model with fewer cells where the data has relatively low resolution. This involves taking the large scale model and performing a mathematical process on it to reduce the number of cells, but it results in a model with much lower accuracy and hence less usefulness. Nevertheless, this approach is still very appealing because it can dramatically reduce the number of parameters to be adjusted in the history matching process. It is then easy for the process to be handled by any well known generic optimizers like GA (Genetic Algorithm) or PSO (Particle Swarm Optimization), which treat any optimization problems as black boxes, i.e., just requiring input (parameters) and output (objective functions) configurations.

There is a need for a way of performing a Karhunen-Loève expansion on a model without this reduction in data quality. What is needed is a way of deriving eigenvectors and eigen values for unadulterated model realizations for full scale practical reservoir simulation which is feasible using present day computing capacity.

SUMMARY OF THE DISCLOSURE

According to one embodiment of the present invention, a method for creating an amended realization of a geostatistical model of a subterranean hydrocarbon reservoir is provided, wherein:

- an amended realization is based on a current realization of the model;
- the current realization comprises at least one petrophysical parameter value for each of a plurality of volume cells; and
- a covariance matrix is associated with the model;
- where the method includes
- creating a plurality of further model realizations from random seeds;
- creating an approximation matrix containing modified values from said plurality of further model realizations;
- deriving from the approximation matrix, e.g. by performing singular value decomposition of the approximation matrix, approximate eigenvectors and approximate eigen values which are approximations of the eigenvectors and eigen values of the covariance matrix;
- using the approximate eigenvectors and approximate eigen values in a Karhunen-Loève expansion to derive one or more amended realizations.

In another embodiment, a method of predicting a flow rate of hydrocarbons from a well in a subterranean hydrocarbon reservoir is provided, including:

- obtaining current hydrocarbon flow rate data from the well;
- using the current flow rate data to condition a geostatistical model of the subterranean hydrocarbon reservoir such that the model is able to provide improved predictions of future flow rates from the well;
- where a covariance matrix is associated with the model, and the method includes the steps of:
- creating a current realization of the model including at least one petrophysical parameter value for each of a plurality of volume cells of the model;
- creating a plurality of additional model realizations from random seeds;
- creating an approximation matrix containing modified values from the plurality of further model realizations;
- deriving from the approximation matrix approximate eigenvectors and approximate eigen values which are approximations of the eigenvectors and eigen values of the covariance matrix;
- using the approximate eigenvectors and approximate eigen values in a Karhunen-Loève expansion to derive one or more amended realizations which reflect the current hydrocarbon flow rate data from the well.

The approximation matrix ΔM may comprise a series of column vectors $\Delta m_i$, each containing values from one of the further model realizations. In this way, the matrix ΔM may have dimensions p×N where p is the number of cells or number of values, if there is more than one value for each cell, in the model and N is a number of further realizations to be combined. This matrix may thus be very much smaller than the full covariance matrix for the same model.

Each term in the matrix may represent in some way the variance, for example each term may represent the deviation of that data point from a mean value. Thus, each term may be a value for a model parameter for a cell with the corresponding average value for that parameter over some or all of the realizations subtracted from it. Of course, each cell may have more than one parameter associated with it.

In this way, a matrix ΔM may be produced which reflects the covariance of the data, by virtue of the fact that data from a number of randomly generated realizations are combined.

The approximation matrix ΔM may be decomposed in the same way as the full covariance matrix, using the known technique of singular value decomposition. Once the eigenvectors and eigen values are derived, the Karhunen-Loève expansion can be calculated and then used in the history matching process. Therefore, according to another embodiment, a history matching process for a hydrocarbon reservoir comprises the method steps set out above.

The invention may be embodied in software stored on a computer readable medium or embodied in a suitably programmed computer.

The method has been found to produce accurate results and is reasonably easily handled by a standard personal computer.

BRIEF DESCRIPTION OF THE DRAWINGS

The following description of a specific example of the invention is given with reference to the accompanying drawings listed below. The description is given by way of example only; the scope of the invention is to be defined only by the claims.

DETAILED DESCRIPTION

A small scale 2 dimensional model (30×30) was created for testing and demonstrating the history matching process according to the invention. The model was created using an industrial standard package which is well known in this field (GSLib from Stanford University, version Gomez 1.0), and comprised values for permeability and porosity within ranges typical for a hydrocarbon reservoir. The values were also statistically inter-related in a way typical of a hydrocarbon reservoir.

Figure 2A:
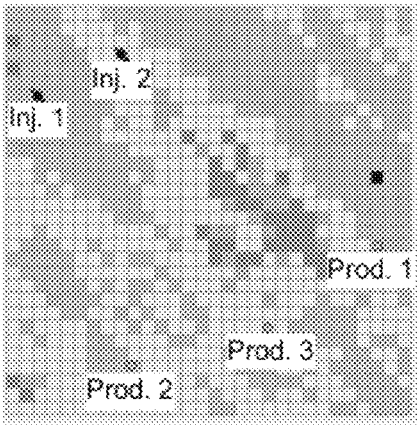
FIG. 2*a* shows one realization of the 30×30 test model, which is treated as an actual reservoir to produce flow data for the purpose of the test.

Firstly, a single random realization was created using the GSLib package; this is shown in FIG. 2*a*. For the purpose of the test, it was assumed that this realization was a 100% accurate representation of a reservoir. This will be called the target realization. Flow data from the target realization was generated using GSLib, and this was used in the test as a substitute for the measured flow rate data which would be used in a real-life history matching process. This flow data was the only information from the target which was used in this example history matching procedure.

Next, 100 random realizations were then generated. A substitute covariance matrix or approximation matrix ΔM was then generated from the 100 realizations. Each column of ΔM comprised a vector $\Delta m_i$ corresponding to one realization, with each parameter replaced by a value calculated by subtracting from that parameter the average (mean) value of the same parameter over all 100 realizations. Each cell of the model was associated with both a porosity and a permeability parameter. The ΔM matrix thus had dimensions 1800×100 since there were two parameters associated with each of the 900 (30×30) cells in the model, and 100 realizations were used.

The true covariance matrix for this small test model would have dimensions 1800×1800, which is substantially larger than the approximation matrix. It will be appreciated that this difference would be even more significant for larger, 3 dimensional models.

From the approximation matrix, the single value decomposition method (SVD) was used to derive 40 eigenvectors. Corresponding eigen values were also calculated. The well known, freely available software LAPACK v.3.0 was used to perform the SVD calculation.

Figure 1A:
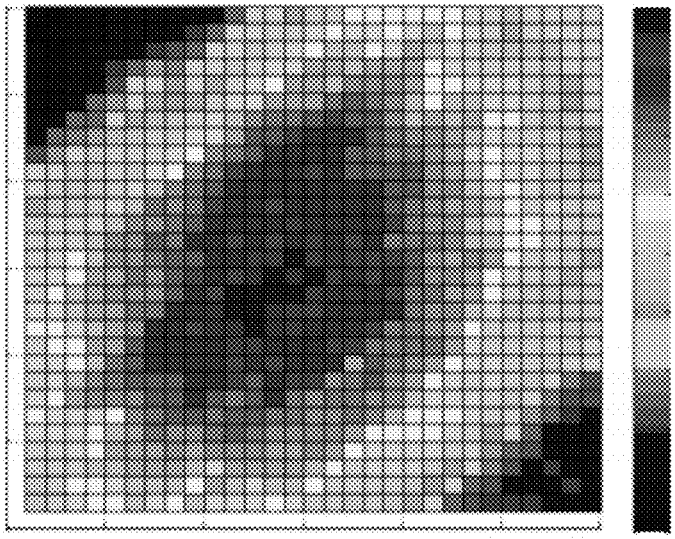
FIGS. 1*a*, 1*b* & 1*c* show plots of eigenvectors for a test using a 30×30 model.
Figure 1B:
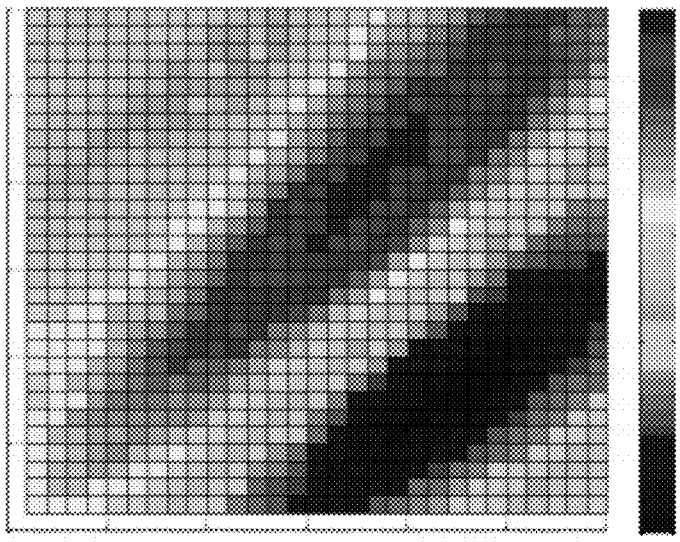
Figure 1C:
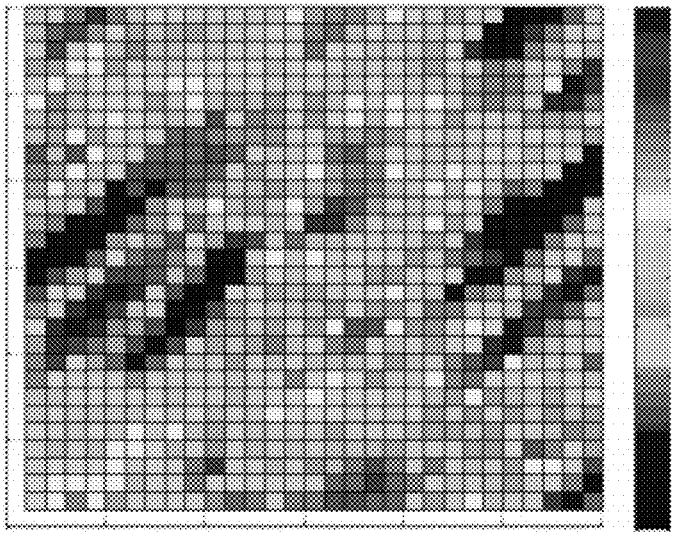

FIGS. 1*a*, 1*b* and 1*c* are graphic representations of three of the eigenvectors produced by this process (represented as 30×30 grids).

Based on these eigenvectors and eigen values the Karhunen-Loève expansion was then used to derive an updated realization by adjusting modifying coefficients $c_j$ to give a modified realization. By adjusting the modifying coefficients $c_j$ it was possible to adjust the amended realization such that the flow data it predicted closely matched the flow data from the reservoir (in this case data predicted by the target realization). The known DGESVD (University of Tennessee) algorithm/software was used for this process.

Figure 2B:
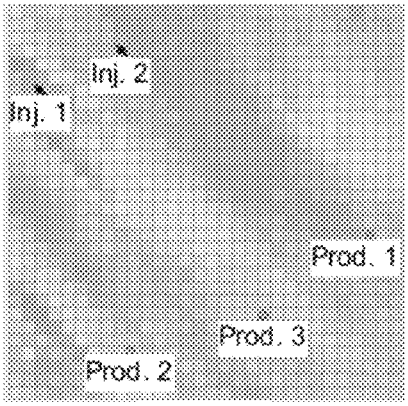
FIGS. 2*b* and 2*c* show two random realizations using the method of the invention but without performing a history matching process.
Figure 2C:
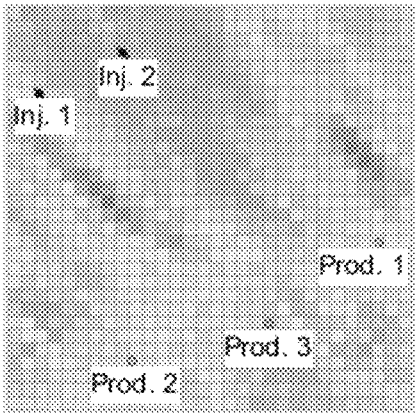
Figure 2D:
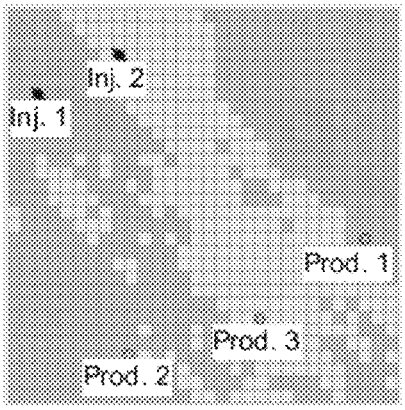
FIGS. 2*d* and 2*e* show two history matched realizations using the method of the invention to match the flow data from the reservoir shown in FIG. 2*a*, so that the realizations more closely represent the reservoir shown in FIG. 2*a*.
Figure 2E:
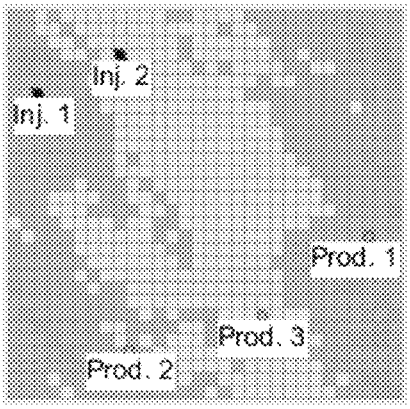

FIGS. 2*d* and 2*e* show two alternative history matched solutions. It can easily be seen how much closer these two realizations are to FIG. 2*a* than are the initial realizations shown in FIGS. 2*b* and 2*c*, which were generated randomly without production history constraints. Here we assume randomly varying the $c_j$ coefficients is approximately equivalent to generating random realizations from geomodeling packages because the eigenvectors which are used contain most information in the covariance matrices if the model is Gaussian or could be converted to a model with a Gaussian probability distribution.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A method for creating an amended realization of a geostatistical model of a subterranean hydrocarbon reservoir, wherein:

a) said amended realization is based on a current realization of the model;

b) said current realization comprises at least one petrophysical parameter value for each of a plurality of volume cells; and c) a covariance matrix is associated with the model, wherein the covariance matrix contains information about variance and statistical inter-dependence of estimated parameter value or values of the model; wherein the method comprises the steps of:

d) creating a plurality of further model realizations from random seeds;

e) creating an approximation matrix containing modified parameter values from said plurality of further model realizations, wherein the approximation matrix comprises series of column vectors, each column vector corresponding to one realization, wherein dimension of the approximation matrix is smaller than dimension of a true covariance matrix, wherein an updated parameter value is calculated by subtracting an average value of the parameter from the parameter value;

f) deriving from the approximation matrix approximate eigenvectors and approximate eigen values which are approximations of the eigenvectors and eigen values of the covariance matrix by performing singular value decomposition on the approximation matrix;

g) using the approximate eigenvectors and approximate eigen values in a Karhunen-Loève expansion to derive one or more amended realizations.

2. A method according to claim 1 wherein the approximation matrix comprises a series of column vectors each containing modified values from one of said plurality of further model realizations.

3. A method according to claim 2 wherein each term in the approximation matrix has been modified to reflect the variance of the data.

4. A method according to claim 3 wherein each term in the approximation matrix is derived by taking each value in a respective one of said further current realizations and subtracting from that value an average of corresponding values in some or all of the others of said further realizations.

5. A non-transitory computer-readable media bearing a program which carries out the method of claim 1.

6. A computer programmed with software which carries out the method of claim 1.

7. A history matching process whereby an amended realization of a geostatistical model of a subterranean hydrocarbon reservoir is produced which reflects dynamic data from said reservoir, wherein:

a) said amended realization is based on a current realization of the model;

b) said current realization comprises at least one petrophysical parameter value for each of a plurality of volume cells; and c) a covariance matrix is associated with the model, wherein the covariance matrix contains information about variance and statistical inter-dependence of estimated parameter value or values of the model;

wherein the process comprises the steps of:

i) creating a plurality of further model realizations from random seeds;

ii) creating an approximation matrix containing modified parameter values from said plurality of further model realizations, wherein the approximation matrix comprises series of column vectors, each column vector corresponding to one realization, wherein dimension of the approximation matrix is smaller than dimension of a true covariance matrix, wherein an updated parameter value is calculated by subtracting an average value of the parameter from the parameter value;

iii) deriving from the approximation matrix approximate eigenvectors and approximate eigen values which are approximations of the eigenvectors and eigen values of the covariance matrix by performing singular value decomposition on the approximation matrix;

iv) using the approximate eigenvectors and approximate eigen values in a Karhunen-Loève expansion to derive one or more amended realizations which reflect dynamic data from said reservoir.

8. A method according to claim 7 wherein the approximation matrix comprises a series of column vectors each containing modified values from one of said plurality of further model realizations.

9. A method according to claim 8 wherein each term in the approximation matrix has been modified to reflect the variance of the data.

10. A method according to claim 9 wherein each term in the approximation matrix is derived by taking each value in a respective one of said further current realizations and subtracting from that value an average of corresponding values in some or all of the others of said further realizations.

11. A non-transitory computer-readable media bearing a program which carries out the method of claim 7.

12. A computer programmed with software which carries out the method of claim 7.

13. A method of predicting a flow rate of hydrocarbons from a well in a subterranean hydrocarbon reservoir, the method comprising:

a) obtaining current hydrocarbon flow rate data from said well;

b) using said current flow rate data to condition a geostatistical model of said subterranean hydrocarbon reservoir such that said model is able to provide improved predictions of future flow rates from the well;

wherein a covariance matrix is associated with the model, wherein the covariance matrix contains information about variance and statistical inter-dependence of estimated parameter value or values of the model, and wherein the method comprises the steps of:

v) creating a current realization of the model comprising at least one petrophysical parameter value for each of a plurality of volume cells of the model;

vi) creating a plurality of further model realizations from random seeds;

vii) creating an approximation matrix containing modified parameter values from said plurality of further model realizations, wherein the approximation matrix comprises series of column vectors, each column vector corresponding to one realization, wherein dimension of the approximation matrix is smaller than dimension of a true covariance matrix, wherein an updated parameter value is calculated by subtracting an average value of the parameter from the parameter value;

viii) deriving from said approximation matrix approximate eigenvectors and approximate eigen values which are approximations of the eigenvectors and eigen values of the covariance matrix by performing singular value decomposition on the approximation matrix;

ix) using the approximate eigenvectors and approximate eigen values in a Karhunen-Loève expansion to derive one or more amended realizations which reflect said current hydrocarbon flow rate data from said well.

14. A method according to claim 13 wherein the approximation matrix comprises a series of column vectors each containing modified values from one of said plurality of further model realizations.

15. A method according to claim 14 wherein each term in the approximation matrix has been modified to reflect the variance of the data.

16. A method according to claim 15 wherein each term in the approximation matrix is derived by taking each value in a respective one of said further current realizations and subtracting from that value an average of corresponding values in some or all of the others of said further realizations.

17. A non-transitory computer-readable media bearing a program which carries out the method of claim 13.

18. A computer programmed with software which carries out the method of claim 13.

* * * * *